United States Patent [19]

Reimers

[11] Patent Number: 4,565,507

[45] Date of Patent: Jan. 21, 1986

[54] RECIPROCATING COMPRESSOR FOR GASEOUS MEDIA

[75] Inventor: Reimer Reimers, Haltern, Fed. Rep. of Germany

[73] Assignee: Flottmann-Werke GmbH, Herne, Fed. Rep. of Germany

[21] Appl. No.: 650,892

[22] Filed: Sep. 17, 1984

[30] Foreign Application Priority Data

Sep. 16, 1983 [DE] Fed. Rep. of Germany ..... 3333468

[51] Int. Cl.[4] ..... F04B 21/02; F04B 39/10

[52] U.S. Cl. ..... 417/564; 137/512.15

[58] Field of Search ..... 417/559, 560, 563, 564, 417/565, 569, 571; 137/512.15

[56] References Cited

U.S. PATENT DOCUMENTS

| | | | |
|---|---|---|---|
| 1,627,680 | 5/1927 | Vollmann | 137/512.15 |
| 2,682,280 | 6/1954 | Nicklas | 137/512.15 |
| 2,725,183 | 11/1955 | Hanson | 137/512.15 |
| 4,283,166 | 8/1981 | Hiraga | 417/269 |

FOREIGN PATENT DOCUMENTS

| | | | |
|---|---|---|---|
| 2910597 | 9/1980 | Fed. Rep. of Germany | 417/564 |
| 1080792 | 12/1954 | France | 417/565 |

*Primary Examiner*—Carlton R. Croyle
*Assistant Examiner*—Donald E. Stout
*Attorney, Agent, or Firm*—Thomas H. Murray; Clifford A. Poff

[57] ABSTRACT

A reciprocating compressor includes an apertured valve disc between a cylinder and a cylinder head. Valve orifices in the disc are arranged about two concentric circles centered on the central axis of the cylinder. The same number of orifices are spaced about each circle and the orifices about the inner circle are offset by half the angular spacing between the orifices spaced about the outer circle. Intake and delivery valve strips and stroke limiters are provided on both sides of the apertured valve disc and connected by a centrally-arranged nut and bolt fastener. The intake and delivery valve strips each comprising a discoidal center area from which narrow, radially-extending arms project outwardly and are formed at their outer ends with circular end portions. A tubular intake duct extends through the top of the cylinder and subdivides the cylinder head chamber into a suction chamber and an outer delivery chamber.

8 Claims, 5 Drawing Figures

RECIPROCATING COMPRESSOR FOR GASEOUS MEDIA

BACKGROUND OF THE INVENTION

This invention relates to a reciprocating compressor for gaseous media and, more particularly, to an apertured valve disc arranged between a cylinder and a cylinder head of such a compressor in which a plurality of intake and delivery valve orifices is arranged in the disc about circles concentric with the axis of the cylinder. On the side of the disc which is remote to the cylinder, there is an intake valve strip and on the other side of the disc, there is an outlet valve strip, both of the strips being acted upon by stroke limiters and secured centrally to the disc.

A valve system is known for reciprocating compressors. Flat valve strips can be used to cover only a single valve aperture but it is possible to use a circular or semicircular ring to cover a number of apertures. The ring is usually secured to two links. All known valve systems of this type share, inter alia, the disadvantage that the aperture cross section or valve-gap cross section is very small in relation to the available piston area. Thus, only medium piston speeds of up to approximately 4 meters per second can be utilized. The unit volume which can be delivered from a cylinder of a reciprocating compressor is limited by the available cross-sectional area of the valve gap and the maximum permissible velocity of the medium through the gap. In valves of this type, for example, when the gaseous medium is air, the largest possible flow velocity of the air is 75 meters per second. Higher flow velocities lead to a pressure drop and heating. Consequently, the only way to achieve an appreciable increase to the flow delivery velocity is indirectly by substantially increasing the cross-sectional area to the valve gap. This area is the product of the peripheral length of the gap opening; of the average gap height, i.e., mean strip lift, and the number of apertures. The maximum permissible average lift to the valve strips depends upon the frequency at which the strips are opened and closed and the mass of the strips. In practice, the average strip lift should not exceed 1.5 millimeters where the maximum possible compressor speed is 3000 revolutions per minute and air is the gaseous medium to insure long life of the parts. It is pointless to provide a valve opening diameter greater than 7 millimeters. Consequently, the only way for increasing the total valve-gap area is to increase the number of the valve gaps not enlarge the valve apertures.

SUMMARY OF THE INVENTION

It is an object of the present invention to provide a reciprocating compressor for gaseous medium and, more particularly, a valve system which can accommodate a considerably greater valve-gap area than possible according to known valve systems without greatly increasing the production costs while accommodating a predetermined piston area with regard to the operating criteria as hereinbefore set forth.

More particularly, the present invention provides a reciprocating compressor for gaseous media, the combination including a cylinder having a piston therein for reciprocating along a central axis of the cylinder, a cylinder head, an apertured valve disc between the cylinder and the cylinder head, the disc having intake and delivery valve orifices angularly spaced equally about inner and outer concentric circles centered at the central axis, the orifices spaced about the outer circle being offset by half the angular spacing between the orifices spaced about the inner circle, an exhaust valve strip including a discoidal center area connected by radial arms extending outwardly therefrom to enlarge end portions disposed between the cylinder and the disc, an intake valve strip including a discoidal center area connected by radial arms extending outwardly therefrom to enlarged end portions disposed between the cylinder head and the disc, stroke limiter means for the intake and exhaust valve strips, and means for securing the stroke limiter means and the exhaust and intake valve strips to the disc.

Thus, according to the invention the apertured valve disc for a reciprocating compressor is formed with valve orifices at equal angular spacings about an inner circle and with the same number of valve orifices at equal angular spacings about an outer circle but offset by half the angular spacing between the orifices on the inner circle, and intake and delivery valve strips each having the form of a discoidal, centrally-pierced area from which narrow, radially-outward extending arms are formed and which merge at their ends into enlarged end portions, preferably circular.

According to another feature of the present invention, the delivery valve orifices are disposed on the outer circle and the intake valve orifices are disposed on the inner circle to insure satisfactory cooling of the delivery valve strips which are subjected to a greater thermal stress than the intake valve strips. Another convenient feature of the present invention provides that a tubular intake duct subdivides a chamber in the cylinder head into an intake chamber and an outer delivery chamber. The tubular intake duct is sealed to the top of the cylinder head. Extending around the intake valve orifices is the tubular intake duct. Conveniently, the intake duct includes a downstream base at its inner end formed with orifices that register with the intake orifices in the apertured disc. The side of the base of the intake duct which is near the cylinder is formed with stroke limiters near the webs between the intake orifices for the arms and for the circular enlargements of the delivery valve strips.

It is advantageous to act upon the flow of intake gases through the intake orifices by providing that each intake orifice has a substantially pear-shaped cross section at the entry side thereof and extends toward the central axis to conform with the space between the arms of the valve strips. The pear-shaped configuration of the intake orifice merges in the apertured disc by way of an inclined wall portion into a circular aperture on the cylinder side of the apertured disc. A principal advantage provided by the present invention is the optimal use of a predetermined piston area achieved by the half spacing and staggered relation between intake orifices and delivery orifices with both types of orifice being present in the same number. Because of the staggered arrangement, the intake valve strips and the delivery valve strips can each take the form of a discoidal, centrally-pierced area from which narrow, outwardly-extending valve strips are formed. By this configuration, a given piston area can accommodate a very large number of intake and delivery orifices having optimal diameters with a resulting increase in the total valve-gap area.

When the intake orifices are situated on the aforesaid inner circle and these orifices are extended by tubular intake ducts, the intake flow of gaseous medium is central. The delivery orifices open into an annular chamber between the intake duct and the casing of the cylinder head so that there is a concentric discharge flow of compressed medium with low pressure losses due to advantageous flow conditions for the compressed gaseous media. A further advantage of placing the outlet valves near the edge of the apertured disc as opposed to placing the valves at a more inward position, is that cooling of the valves near the edge of the disc is more intense, thereby reducing heating of parts of the delivery valves. This is very important when the compressor receives gaseous media having a relatively high compression exponent such as air. The increased valve-gap area made possible by the present invention enables an increased piston speed of up to 7 meters per second and provides a simple means for increasing the delivery of compressed media and, therefore, provides a specific reduction to the capital investment required for a reciprocating compressor. The higher piston speed also makes possible the use of high-speed diesel engines which can operate at speeds of about 3000 revolutions per minute to form a driving unit which is directly coupled to the compressor as an alternative to the use of an electric motor. Also, the fact that the delivery valve discs and stroke limiters are satisfactorily cooled reduces the risk that lubricating oil will be carbonized. The concentric intake and delivery flows of media reduce pressure losses and, therefore, heating of the valve elements.

These features and advantages of the present invention as well as others will be more apparent when the following description is read in light of the accompanying drawings, in which.

Figure 1:
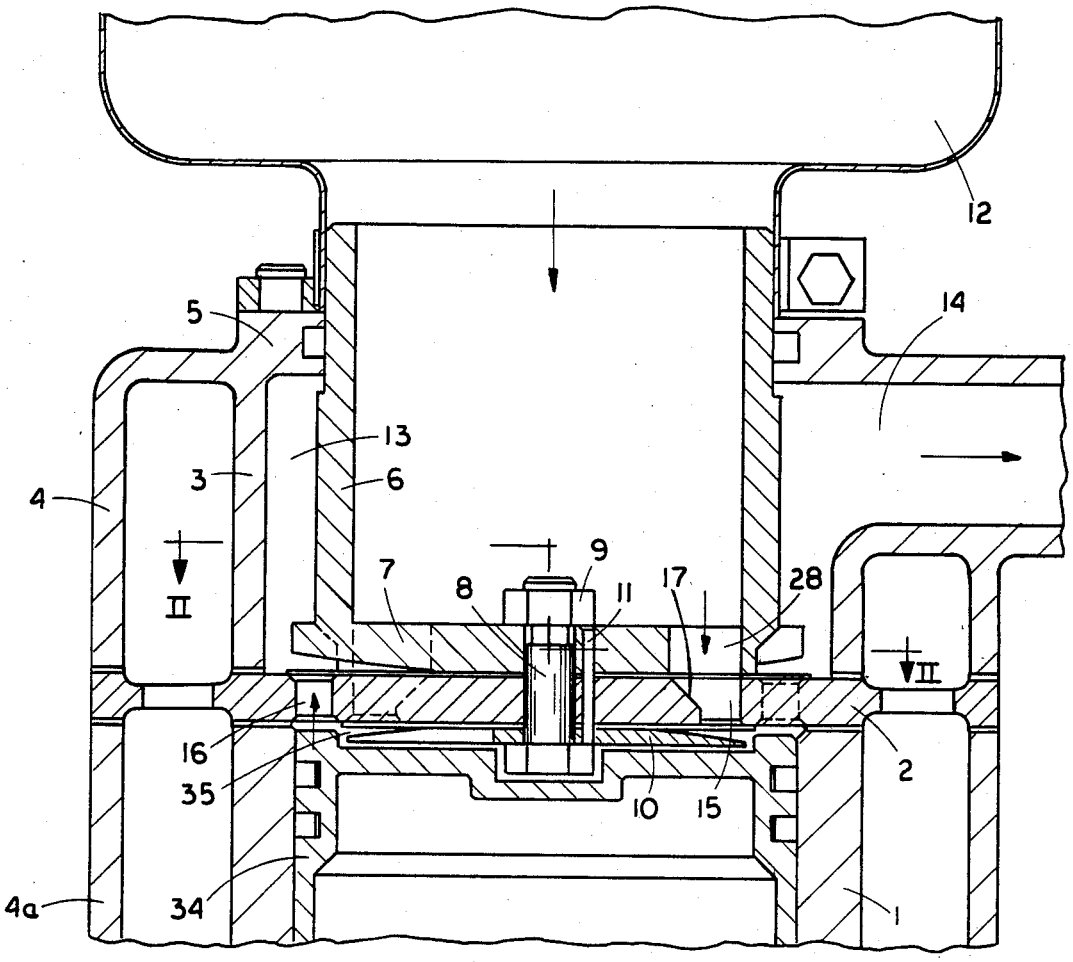
FIG. 1 is a vertical sectional view taken along line I—I of FIG. 2 to illustrate the cylinder valve system and cylinder head of a reciprocating compressor according to one embodiment of the present invention.

In FIG. 1, there is illustrated the top end portion of a cylinder 1 of a reciprocating compressor embodying the features of the present invention. An apertured valve disc 2 is disposed between the cylinder 1 and a cylinder head 3. Jackets 4 and 4*a* extending around the cylinder 1 and the cylinder head 3, respectively, form annular chambers adapted to receive a coolant. The cylinder head 3 includes a top 5 through which a tubular intake duct 6 extends. Duct 6 has an inner base 7 by which intake air communicates with the apertured valve disc 2. A threaded fastener in the form of a threaded bolt 8 is received in central bores provided in disc 2 and base 7. A nut 9 is received on the threaded portion of bolt 8 to rigidly interconnect the disc 2, base 7 and a stroke limiter 10. The stroke limiter, as illustrated in FIG. 1, is arranged to engage the disc 2 on the side thereof facing toward the cylinder 1. As will be described in greater detail hereinafter, valve strips are arranged at opposite sides of the disc 2. A pin 11 extends along a small continuous bore provided adjacent the bolt 8 in the base 7, disc 2 and stroke limiter 10 in positive engagement therewith and forms means for securing these parts against rotation.

A filter 12 is provided above the entry end of duct 6 to supply gaseous medium to the duct. An annular chamber 13 extends about an outer surface of duct 6 inside the cylinder head 3 forming a delivery chamber from which compressed medium issues to a delivery port 14. The apertured disc 2 is formed with a number of intake and delivery orifices on two circles which are concentric and centered at the longitudinal axis of disc 2. The two circles which have different diameters contain the same number of intake and delivery orifices. The orifices are spaced apart by the same angular spacing over the entire peripheries of the circles. The orifices on the inner circle are offset by half the angular spacing between the orifices on the outer circle. In the preferred embodiment shown in the drawings, the orifices spaced about the outer circle comprise delivery orifices 16 for the gaseous media and the orifices angularly spaced about the inner circle form intake orifices 15 for the gaseous medium. The angular spacing between the orifices about each circle is approximately 30°. The circle about which the intake orifices 15 are disposed is approximately 20% smaller than the circle about which the delivery orifices are disposed.

Figure 2:
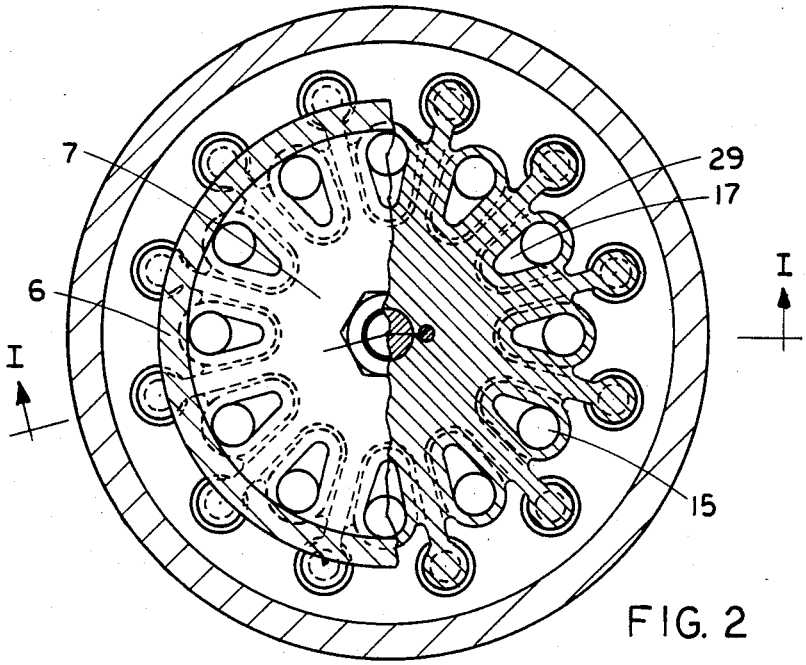
FIG. 2 is a sectional view taken along line II—II of FIG. 1.

The intake orifices 15 are each enlarged by extending substantially in a pear-shaped configuration toward the cylinder axis as clearly shown in FIG. 2. The enlargement of each intake orifice forming the pear-shaped configuration merges in the disc by way of an inclined wall portion 17 into a circular orifice at the cylinder side of the disc 2. When the members of the intake valve structure are made of steel or cast iron, the intake and delivery orifices are formed by machining operations. When aluminum is selected, the orifices can be formed by die casting techniques with subsequent metalworking operations required only to form two sealing surfaces at the opposite sides of the disc.

Figure 3:
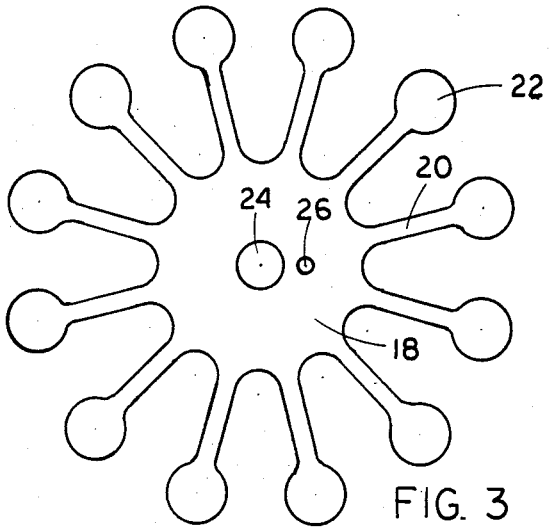
FIG. 3 is a plan view of a delivery valve strip for an apertured valve disc forming part of the valve system of the present invention.
Figure 4:
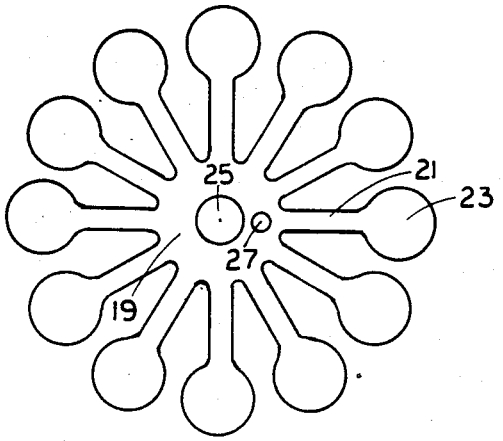
FIG. 4 is a plan view of an intake valve strip for an apertured valve disc forming part of the valve system of the present invention.

FIGS. 3 and 4 illustrate the configuration of intake and delivery strips, respectively. The delivery strip includes a discoidal center area 18 from which narrow radial arms 20 extend outwardly and at their ends merge into circular enlarged portions 22. The discoidal center area 18 is provided with a central bore 24 and adjacent thereto is a smaller bore 26. Bolt 8 (FIG. 1) can extend through the central bore 24 and pin 11 can extend through bore 26 for securing the delivery strip to disc 2 at the side thereof facing away from the cylinder. In a similar way, as shown in FIG. 4, the intake strip includes a discoidal center area 19 from which narrow radial arms 21 extend outwardly and merge at their outer ends into circular end portions 23. The discoidal center area is provided with a central bore 25 for bolt 8 and a smaller bore 27 for pin 11 by which the intake strip is secured to the disc 2 at the side thereof facing toward the cylinder.

The construction of the valve parts as set forth above provides a very suitable arrangement for a reciprocating compressor having a piston diameter between 70 and 100 millimeters. The intake strip preferably has a thickness of, for example, 0.15 millimeter and the delivery strip has a thickness of, for example, 0.3 millimeter. Corrosion-resistant spring steel is the preferred material to form the intake and delivery strips. The strips are preferably produced by conventional stamping operations. The stroke limiter 10 for the intake strip has the same configuration as the intake strip shown in FIG. 4. The stroke limiter surface which is near the disc 2 is convex. The stroke limiter for the delivery strip is formed by web zones between the intake orifices 15 on the underside of the base 7 of the intake duct 6. The web zones, which form abutment surfaces for the arms 20 and the enlarged end portions 22 of the delivery strips embody a shape corresponding to the contour of the delivery strip shown in FIG. 3. The shape, in cross section, of the stroke limiter is illustrated in FIG. 2. As in the case of the stroke limiter 10, the web zones serving as abutment surfaces are convex. However, other portions at the bottom of the base 7 are disposed in a plane perpendicular to the axis of the cylinder. The latter portions are formed, inter alia, with continuous apertures 28 of the same cross-sectional shape as at the entry side of the intake orifices 15.

Pear-shaped gaskets 29 made of soft, resilient plastic are provided at the appropriate places to seal the rubbing surfaces of the base 7 and the disc 2 which bounds the intake orifices 15. Each gasket 29 has a thickness of about 1.2 times the thickness of the delivery strip. The gaskets 29 are compressed to the thickness of the delivery strip by application of suitable torque to nut 9 so that the delivery strip is operatively clamped to the disc 2.

Figure 5:
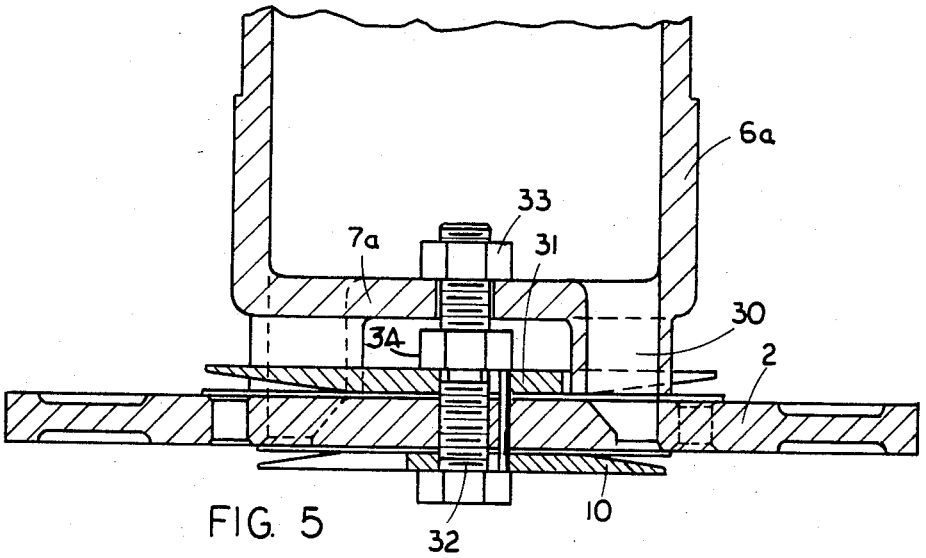
FIG. 5 is a vertical view, in section, similar to FIG. 1 and illustrating a second embodiment of the present invention.

FIG. 5 illustrates a further embodiment of the present invention in which an intake duct **6*a* is provided with a base 7*a* which does not form a stroke limiter for the delivery strip. Instead, a separate limiter 31 is provided and constructed in the same way as the intake stroke limiter 10 as described hereinbefore. By this construction, the base 7*a* is spaced at a distance from the disc 2 and is formed about ports 30 with extensions that project toward and engage with the disc 2. The extensions surrounding ports 30 engage disc 2 in a sealed manner with the intake orifices 15. A threaded fastener 32 which has an elongated threaded portion receives a first nut 33 for firmly attaching the duct 6*a* by way of base 7*a* to the disc 2 and a second nut 34 for independently securing the valve strips and stoke limiters to the disc 2**.

In the operation of the apparatus of the present invention, when a reciprocating piston 34 as shown in FIG. 1 moves downwardly from its top dead-center position in cylinder 1, as shown, the piston draws gaseous medium through filter 12 into the intake duct 6 and thence through the apertures 28 in base 7. The gaseous medium is then drawn through intake orifices 15 in the disc 2 and thence into the cylinder chamber 35. The arm portions 21 and the enlarged end portions 23 of the intake strips are in engagement with the limiters 10 because of the negative pressure in the cylinder 35 and thus allow the gaseous medium to pass into the chamber. During the intake period, the arms 20 and the enlarged end portions 22 of the delivery strips respond only as the piston 34 moves upwardly from a bottom dead-center position in the cylinder; specifically, when the resulting compression pressure slightly exceeds the pressure in the cylinder head chamber 13. When the delivery strips are defined into an open position, the enlarged end portions 22 at the ends of arms 20 simultaneously engage the associated stroke limiters. At the same time, the intake strips embodied by arms 21 and the enlarged end portions 23 close the intake or suction chamber in the intake duct 6.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A reciprocating compressor for gaseous media, said compressor including the combination of:

a cylinder having a piston therein for reciprocating along a central axis of said cylinder a cylinder head, an apertured valve disc secured between said cylinder and said cylinder head, said disc having intake and delivery valve orifices angularly spaced equally about inner and outer concentric circles centered at said central axis, the orifices spaced about the outer circle being offset by half the angular spacing between the orifices spaced about the inner circle, an enhaust valve strip comprising a discoidal center area connected by radial arms extending outwardly therefrom to enlarged end portions disposed between said cylinder and said disc to only one of said delivery valve orifices, an intake valve strip comprising a discoidal center area connected by radial arms extending outwardly therefrom to enlarged end portions disposed between said cylinder head and said disc to only one of said intake valve orifices, the radial arms of one of said exhaust valve strip and intake valve strip having a width to extend between said orifices spaced about said inner circle, stroke limiter means for said intake and exhaust valve strips, and means for securing said stroke limiter means and said exhaust and intake strips to said disc.

2. The compressor according to claim 1 wherein the enlarged end portions of each said intake valve strip and said exhaust valve strip are circular enlargements at the ends of the radial arms.

3. The compressor according to claim 2 wherein the intake valve orifices of said disc are disposed on said inner circle, and wherein the delivery valve orifices of said disc are disposed on said outer circle.

4. The compressor according to claim 1 wherein an entrance to each intake valve orifice of said disc is substantially pear-shaped in cross section for conforming to a space between the radial arms of said exhaust valve strips, the pear-shaped cross section merging on the narrow side thereof in said disc by an inclined wall portion into a circular orifice at the side of said disc facing toward said cylinder.

5. A reciprocating compressor for gaseous media, said compressor including the combination of:

a cylinder having a piston therein for reciprocating along a central axis of said cylinder, a cylinder head, an apertured valve disc secured between said cylinder and said cylinder head, said disc having intake and delivery valve orifices angularly spaced equally about inner and outer concentric circles centered at said central axis, the orifices spaced about the outer circle being offset by half the angular spacing between the orifices spaced about the inner circle, an exhaust valve strip comprising a discoidal center area connected by radial arms extending outwardly therefrom to enlarged end portions disposed between said cylinder and said disc to only one of said delivery valve orifices, an intake valve strip comprising a discoidal center area connected by radial arms extending outwardly therefrom to enlarged end portions disposed between said cylinder head and said disc to only one of said intake valve orifices, the radial arms of one of said exhaust valve strip and intake valve strip having a width to extend between said orifices spaced about said inner circle, stroke limiter means for said intake and exhaust valve strips, and means for securing said stroke limiter means and said exhaust and intake strips to said disc, and a tubular intake duct extending around the intake orifices at the side of said disc facing said cylinder head for forming an intake chamber an an outer delivery chamber by subdividing a chamber in said cylinder means, said cylinder head having a cylinder head top through which said tubular intake duct extends in a sealed relation.

6. The compressor according to claim 5 wherein said tubular intake duct includes a base downstream at the inner end thereof, said base having apertures aligned with said intake valve orifices of said disc.

7. The compressor according to claim 6 wherein said stroke limiter means for the arms and enlarged end portions of said exhaust valve strips are defined by a side portion of said base facing toward said cylinder near web portions between the intake valve orifices of said disc.

8. The compressor according to claim 7 wherein said base includes extensions surrounding the apertures therein for extending in a sealed relation to the said intake valve orifices of said disc, the extensions of said base spacing the base from said disc.

* * * * *